United States Patent [19]

Masbruch et al.

[11] Patent Number: 4,866,804

[45] Date of Patent: Sep. 19, 1989

[54] QUICK CONNECT/DISCONNECT FOR A SURFACE CLEANING MACHINE

[75] Inventors: Richard D. Masbruch, Ransomville; Arthur A. Andrews, Alden, both of N.Y.

[73] Assignee: Tennant Trend, Inc., Niagara Falls, N.Y.

[21] Appl. No.: 233,449

[22] Filed: Aug. 18, 1988

Related U.S. Application Data

[63] Continuation-in-part of Ser. No. 109,773, Oct. 16, 1987, abandoned.

[51] Int. Cl.[4] ..... A47L 11/164

[52] U.S. Cl. ..... 15/49 R; 51/177

[58] Field of Search ..... 15/28, 29, 49 R, 50 R, 15/49 C, 50 C, 180, 385, 98; 51/168, 176, 177

[56] References Cited

U.S. PATENT DOCUMENTS

| | | | |
|---|---|---|---|
| 2,727,262 | 12/1955 | Gerber | 15/49 |
| 2,870,468 | 1/1959 | Barel | 15/49 |
| 3,019,465 | 2/1962 | Bayless | 15/180 |
| 3,055,030 | 9/1962 | Ardito | 15/49 |
| 3,122,765 | 3/1964 | Magarian | 15/49 |
| 3,401,416 | 4/1968 | Ziegler | 15/49 |
| 4,094,034 | 6/1978 | Wilkins | 15/49 R |
| 4,096,599 | 6/1978 | Mayo | 15/49 R |
| 4,476,602 | 10/1984 | Hurn | 15/28 |

*Primary Examiner*—Edward L. Roberts

*Attorney, Agent, or Firm*—Kinzer, Plyer, Dorn, McEachran & Jambor

[57] ABSTRACT

This is concerned with a surface cleaning machine such as a burnisher or scrubber and is more particularly concerned with a quick connect/disconnect holding and centering structure for high speed brush and pad use which is specifically constructed to accurately center a brush or pad and dampen any vibration so that the brush or pad may be operated at a high speed without special balancing, as well as to allow for each and quick connect or disconnect. The holding and centering structure comprises an opening in the center of a surface cleaning element adapted to receive a driven hub fitted down in the opening. A circumferential formation in the opening is adapted to interferingly bypass a complementary circumferential formation on the hub. One of the circumferential formations is uniformly distortable.

31 Claims, 4 Drawing Sheets

Fig. 9.
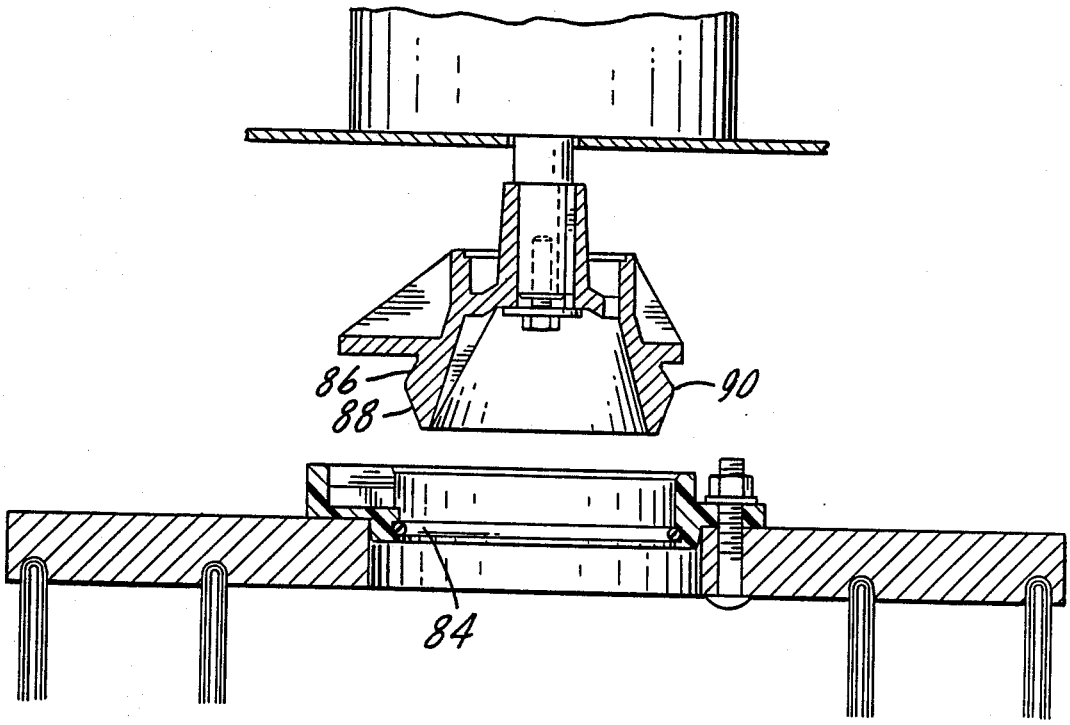
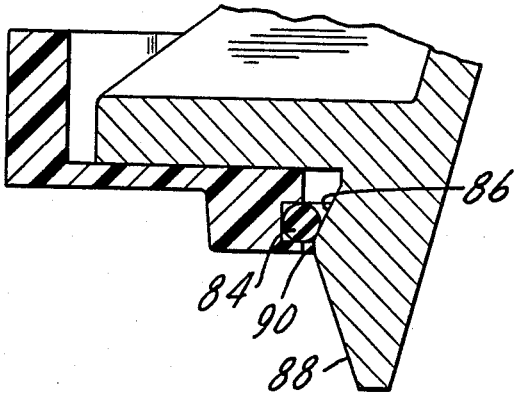
Fig. 10.
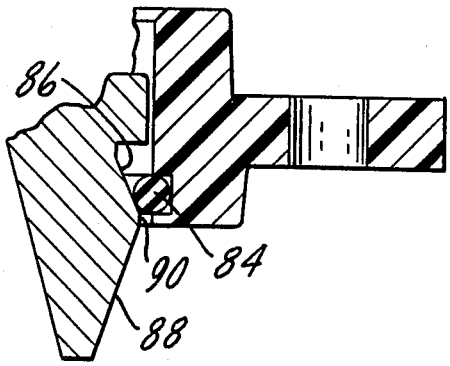
Fig. 11.

QUICK CONNECT/DISCONNECT FOR A SURFACE CLEANING MACHINE

This is a continuation in part of application Ser. No. 109,773 filed Oct. 16, 1987, now abandoned.

SUMMARY OF THE INVENTION

This invention is concerned with a quick connect-/disconnect coupling for a brush or pad driver that releasably holds and centers a surface cleaning tool, whether it be a brush for sweeping or scrubbing or a pad for burnishing.

A primary object of the invention is a quick connect-/disconnect which eliminates any balancing problems.

Another object is a connect/disconnect with a close toleranced pilot for proper centering.

Another object is a connect/disconnect of the above type with an excellent centering and holding force.

Another object is a connect/disconnect of the above type in which the brush/pad is dampened from the drive plug thereby reducing noise and vibrations.

Another object is a connection of the above type that eliminates drive noise and rattle between the driver and drive plug.

Another object is a connection of the above type that provides centering for high speed burnishing use.

Another object is a connection of the above type that eliminates the need for mechanical fasteners to hold the cleaning tool and to thereby ease assembly and disassembly.

Another object is a connection of the above type that uses an O-ring as an isolator between the two drive components.

Another object is a connect/disconnect of the above type in which the parts go together in response to straight axial movement rather than a twisting motion which a freely turning motor drive shaft would tend to defeat.

Another object is a connect/disconnect coupling of the above type which uses an O-ring to hold the brush-/pad driver and the drive hub in axial engagement when the coupling is connected.

Another object is a connect/disconnect of the above type which uses a multi-lobed driver that drives through pure radial surface contact, which helps eliminate vibration, noise, and the need for balancing the surface cleaning tools.

Another object is a connect/disconnect of the above type which uses a multi-lobed driver that allow for 180° head-on force or drive angle thereby eliminating unevenness in the centrifugal force which helps eliminate vibration noise and the need for balancing tools.

Another object is a connect/disconnect of the above type that is unsurpassed in ease of assembly and disassembly.

Another object is a connect/disconnect which eliminates adjustments and secondary operations to install or remove a brush or pad.

Another object is a connect/disconnect that provides positive centering.

Another object is a connect/disconnect of the above type that eliminates the need for balancing brushes and pad drivers for speeds up to on the order of 1600 rpm.

Another object is a connect of the above type that is low in cost.

Other objects will appear from time to time in the ensuing specification and drawings.

BRIEF DESCRIPTION OF THE DRAWINGS

FIG. 9 is an axial section of a variant form;

FIG. 10 is a section, on an enlarged scale, of part of FIG. 9 with the elements assembled; and FIG. 11 is an axial section, similar to FIG. 10, of a further variant;

BRIEF DESCRIPTION OF THE PREFERRED EMBODIMENT

Figure 1:
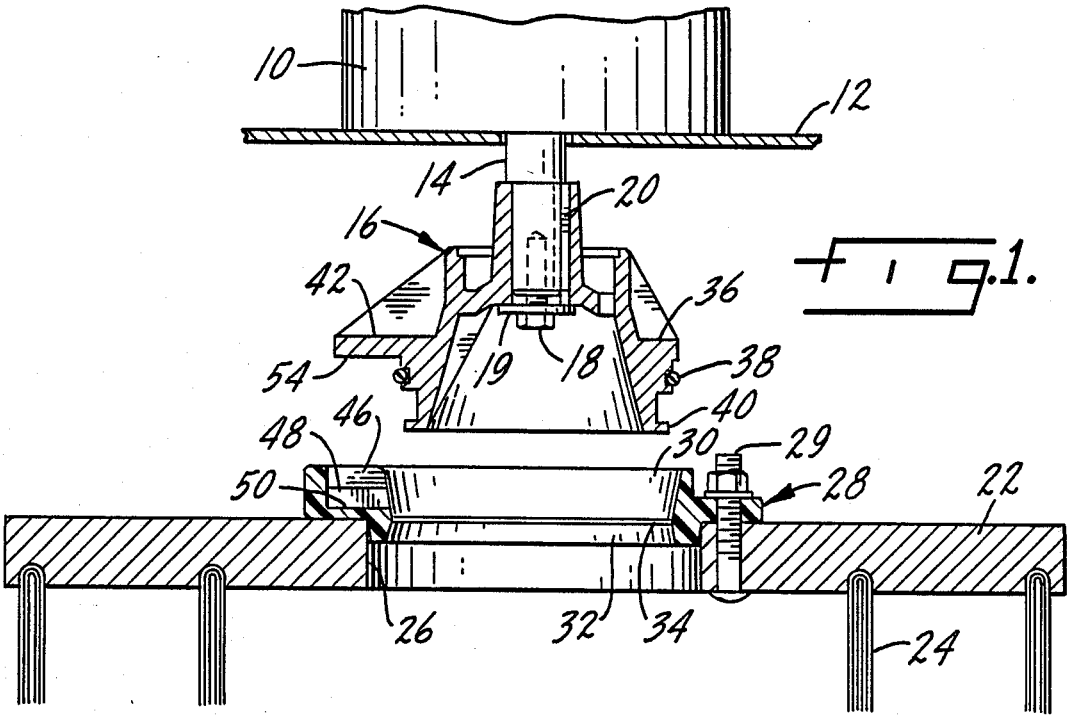
FIG. 1 is an axial section of a surface cleaning tool with the quick connect/disconnect and drive motor.
Figure 2:
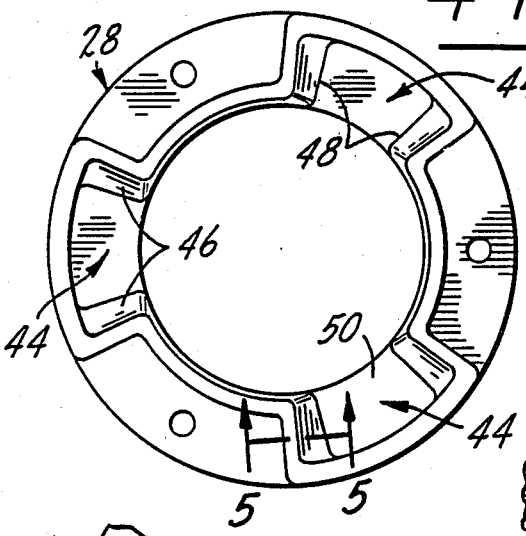
FIG. 2 is a top plan view of the brush ring of FIG. 1.

In FIG. 1 a portion of a conventional scrubber or buffing machine has been shown, partially disassembled, in which a drive motor 10 is suitably mounted on a part of the machine mechanism or frame 12 with a drive shaft 14 extending downwardly therefrom. A drive hub 16 is suitably mounted on the shaft 14 by a bolt 18 and washer 19 or the like with a key 20 or the like.

A disk brush backing 22 with bristles 24 on the lower surface therefrom has been shown and it should be understood that this is merely representative. Instead of a brush it could be a buffing pad. The disk has a center opening 26 in which is mounted a ring 28 which is held therein by suitable bolts 29 or the like. Any suitable fastening means may be used. The inner surface of the ring has an upper downwardly converting frusto conical surface 30 and a lower downwardly diverging frusto conical surface 32. A narrow cylindrical surface 34 is provided where the two conical surfaces 30 and 32 would intersect if they were extended, which provides a restricted inside diameter in the hub.

The hub has a circular flange or body 36 with an O-ring 38 mounted below it, as shown in FIG. 1, followed by a lower pilot 40. The pilot is of a size to guide the hub into the center of the ring 28 with a close tolerance fit through the restriction 34.

Figure 3:
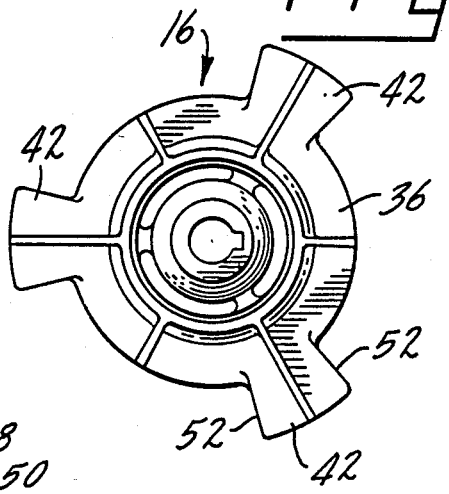
FIG. 3 is a top plan view of the hub in FIG. 1.
Figure 5:
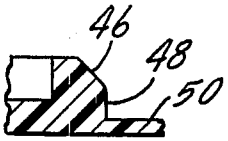
FIG. 5 is a section along line 5—5 of FIG. 2.

The hub has a plurality of outstanding lobes 42, shown in this case as 3 in FIG. 3, which fit in corresponding sockets 44 on the upper surface of the ring 28. Each socket has its two side surfaces initially beveled or tapered or angled as at 46 followed by a right angle wall 48 leading to a bottom surface 50 as shown in FIG. 5. The side surfaces 52 of the lobes are vertical and, when the lobes are fully seated in the sockets, will engage vertical surfaces 48 in the sides of the sockets.

Figure 4:
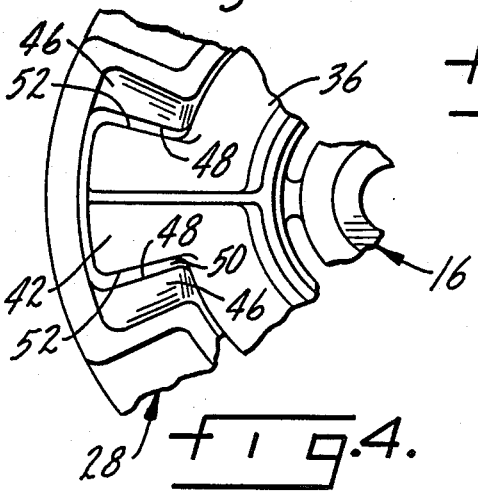
FIG. 4 is a partial top plan view of the hub and ring assembled.

When the hub and ring are brought together, the beveled surfaces 46 on the sides of the sockets guide the lobes into the sockets, as shown in FIG. 4 where the flat sides 52 of the lobes oppose the flat sides 48 in the sockets.

Figure 6:
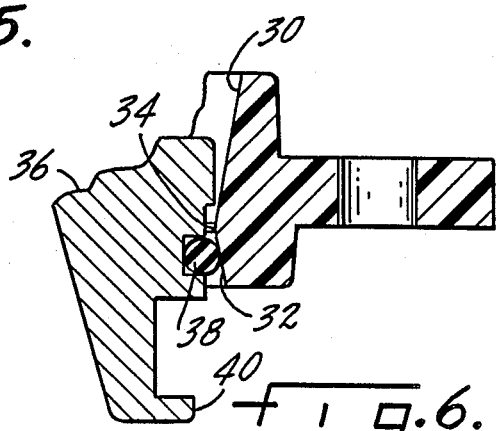
FIG. 6 is a section, on an enlarged scale, of part of FIG. 1 with the elements assembled.
Figure 7:
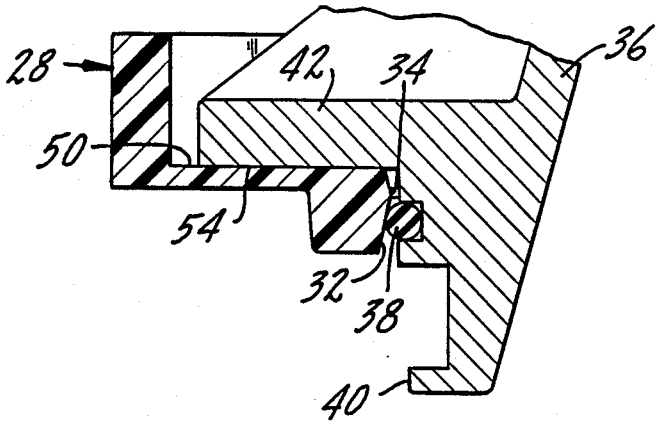
FIG. 7 is a section, on an enlarged scale, similar to FIG. 6 with the elements on the other side of the hub and ring assembled.

The bottom or lower surfaces 54 of the lobes are coplanar and engage the coplanar flat bottoms 50 in the sockets. The dimensioning is such that the O-ring is squeezed or compressed when it passes through the restriction 34 in the ring. This is to say that the outside diameter of the O-ring is somewhat greater than the inside diameter of the restriction 34. A certain amount of force must be applied to cause the O-ring to move past the restriction 34. When the hub is fully seated in the ring with the bottoms 54 of the lugs engaging the bottoms 50 of the sockets, the O-ring will have been squeezed through the restriction 34 in the ring and will be on the other side, as shown in FIG. 6. In this fully sealed position the O-ring should still be under a certain amount of compression or preload of a magnitude so that under operating conditions the brush or pad will be retained on the hub.

The side faces 52 of the lobes on the hub are in the radial plane of the hub center line. The side faces 48 of the sockets are also in a radial plane through the ring center line. The result is that a flat side-face-to-side-face rotary drive will be applied by the hub to the ring without misalignment.

Figure 8:
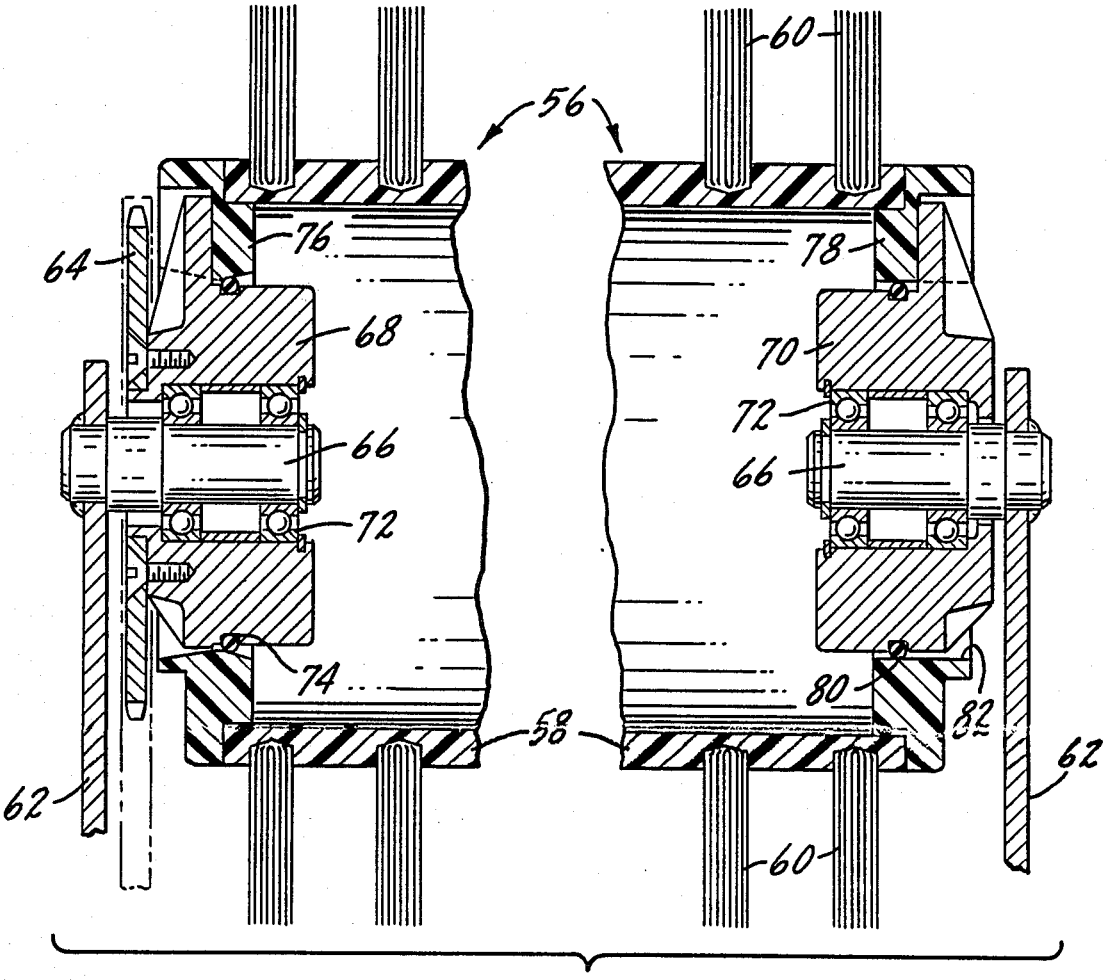
FIG. 8 is an axial section through a modified form.

In FIG. 8 a variant form has been shown in which a cylindrical brush indicated generally at 56 has an outer cylinder 58 with bristles 60 circumferentially formed or socketed therein. The cylindrical brush may be assumed to be supported at each end by arms 62 with a drive at 64. A stub shaft 66 at each end supports a lobed driver 68 on the left and another 70 on the right through suitable bearings 72. The mounting arrangement on the left may be the same as before in which an O-ring 74 is squeezed through a restriction formed in a driver ring 76 mounted in the end of the cylindrical brush. When the lobes are fully seated in the sockets, the O-ring will be under a certain amount of compression or preload against or inside of a diverging conical surface.

The other end also has a hub with lobes that fit in sockets in a driver ring 78 mounted in the end of the cylindrical brush. An O-ring 80 on the hub bears against a generally cylindrical surface 82 in the drive ring. The O-ring 74 at the other end tends to bias the hub into the drive ring 76 or, stated another way, tends to interlock the two or force the lugs fully into their sockets. The O-ring 80 at the right does not bias its hub one way or the other so it is free to accommodate itself to the cylindrical surface 82.

While the assembly has been shown with the O-ring on the outside of the hub and the restriction 34 on the inside of the ring, it should be understood that this may be reversed. For example the O-ring could be positioned in a groove in the ring 28 with an external diameter on the hub being forced through it. This is to say that the ramp or catch could be on the hub and the O-ring on the brush or pad ring. For example, in FIGS. 9 through 11 the O-ring 84 is shown as mounted in a suitable groove in the ring assembly bolted or otherwise connected to the brush and the conical surfaces 86 and 88 defining the narrow cylindrical surface 90 are shown on the hub. The dimensioning, angles, etc., could be as before.

Figure 12:
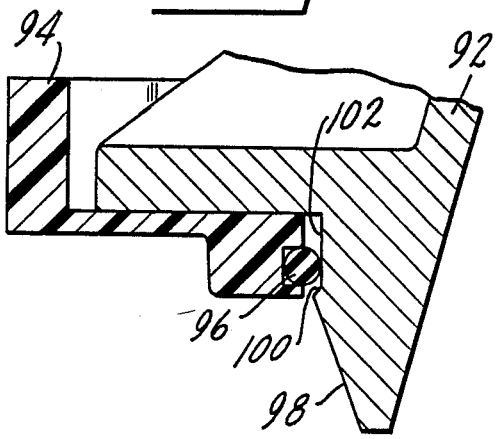
FIG. 12 is an axial section of a further variant.

In FIG. 12 a further variant has been shown in which the hub 92 and ring 94 are shown with the O-ring or distortable annulus 96 mounted in a suitable groove in the ring 94. The outer surface of the hub has a lower frusto conical surface 98, as before, with the upper surface being changed into a short ramp or frusto conical surface 100 topped by a generally cylindrical surface 102. In this relationship it would be noted that when the interlocks are fully seated the O-ring 96 is spaced a short distance above the ramp surface 100 which is to say that the O-ring will be under radial compression against cylindrical surface 102 but not against a frusto conical surface such as at 86 in FIG. 10. It has been found that for certain high speed operations on a level floor the O-ring should be under a certain preload to accurately and adequately center the tool. Manufacturing tolerances to achieve this are less critical on a cylindrical surface such as 102, which has only a radial dimension, than on a sloping surface such as 100, where both radial and axial dimensions are very important.

Additionally, when operating on uneven floors the O-ring has been known to pop over the annulus which has caused accelerated wear of the O-ring and allows the tool to fall off. In the FIG. 12 form the O-ring is above the ramp surface 100 a certain distance which gives it some latitude to move up and down slightly before coming in contact with the annulus or ramp. This will prevent the O-ring from popping over the interference annulus and will allow for better operation on more uneven floors. The cylindrical surface 102 allows for a more controllable and tighter fit making it operable at higher speeds. The O-ring only needs to be a few thousandths smaller than surface 102 which is sufficient to captivate the tool and, at the same time, still allow for easy removal.

Figure 13:
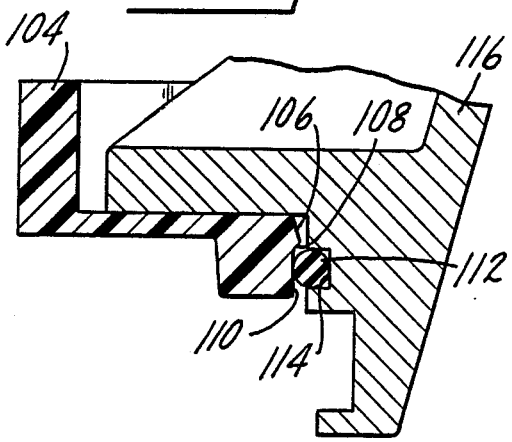
FIG. 13 is similar to FIG. 7 but of a further modification.

FIG. 13 is a further variant, similar to FIG. 12 but the reverse. The ring 104 has a frusto conical surface 106 with a short ramp 108 and generally cylindrical surface 110 below it. The O-ring or distortable annulus 112 is mounted in a groove 114 in the hub 116. As in FIG. 12, when the interlocks are fully seated or engaged the O-ring is spaced somewhat from the ramp 108 which gives the ring and brush some latitude to move up and down on the hub. This is like FIG. 12 but reversed so that the O-ring is on the hub, like FIG. 1. The forms of FIGS. 12 and 13 could be applied to the FIG. 8 form as could the FIGS. 10 and 11 form.

The use, operation and function of the invention are as follows.

The invention is in the nature of a quick connect/disconnect coupling which is particularly advantageously useful in scrubbing or buffing machines.

The quick connect/disconnect disclosed and claimed herein includes a drive hub which is connected to a source of power, in this case an electric motor, and a ring which is bolted or otherwise connected to the pad or brush backing. While the ring has been shown and referred to as being made of plastic it should be understood that it can be made of any suitable material. In fact, the ring and backing disk 22 for the brush or pad may be made integral rather than two pieces bolted together. This is to say that an integral ring and backing could be entirely formed of plastic or any other suitable material. The invention might take on the character of an integral backing and ring in which the ring is in the nature of a formation formed on one side of the tool, i.e. the opposite side from the brush bristles or burnishing pad.

While the invention has been disclosed and referred to in connection with a center opening in a brush, the opening does not necessarily have to pass all the way through and under certain curcumstances the ring formation and opening could be in the nature of a socket with a closed bottom.

In the FIG. 1 form as shown, the pilot 40 has a close tolerance fit with the restrictions 34 so the pilot serves to guide the hub down into the opening in the ring. The tapered or frusto conical surface 30 at the top of the ring is preferably on the order of 10° to the vertical which eases centering and pressing onto the ring. The lower taper or frusto conical section 32 also is on the order of 10° to the vertical which is believed to be the most workable. While 10° has been stated for both it should be understood that it may be otherwise.

While three lobes are shown on the hub it should be understood that more or less may be used. Three are preferred in that this gives a good balance.

In assembly the brush or pad driver assembly is slide under the drive hub and then upward so that the pilot 40 of the hub engages the entrance taper 30 of the ring, with the lobes 42 of the hub guided into the sockets 44 in the ring by the beveled sides 46 on each socket. The O-ring 38 slides down surface 30 and is compressed. And some force will be required to squeeze the O-ring through the restriction 34. Thereafter as it begins to expand in the lower taper 32, the bottoms 54 of the lugs engage the bottom 50 of the sockets so that movement stops generally in the position shown in FIG. 6. At this point the dimensioning is such that the O-ring is still under a sufficient degree of compression such that the ring and brush or pad will be retained on the hub.

The result is that the O-ring snaps into the reverse taper 32 and captivates itself. The taper 32 eases disassembly. The O-ring remains in its squeezed mode when in the captivated position shown in FIG. 6. This insures positive centering for good balance which is desirable for high speed operation, for example on the order of 1500 rpm. This also insures adequate holding force. The holding force however should not be sufficiently great that it would require excess force to pull the assembly off the hub for replacement.

The O-ring also acts as a dampening member to eliminate noise generated in most drive systems as metal and/or plastic parts make contact.

The inside restriction 34 does not have to be continuous but could be in segments or sections as long as the sections are evenly spaced. However, it is believed that a continuous circle will provide the most positive centering and the best O-ring wear.

When the device is in use with the assembly lowered to the floor and pressure applied either in buffing or scrubbing, the force will be evenly distributed through the three lobes.

When the brushes or pad drivers are driven by the motor in either direction, the torque applied thereto will be evenly distributed through the drive mechanism. The sides of the lobes are in line with the center of the hub which is also the case with the sides of the ring sockets. The surfaces of the hub and ring thus make pure radial surface contact with each other. There is no angular component of contact such as might be the case with triangles, squares, hexagonals, etc. The result is that there is no adverse force generated that would create an uneven pull to one side which would cause balancing problems.

The device has no mechanical fasteners, can be easily applied and removed by one person and will have long life. It is inexpensive and does not require any extensive special tooling or the like.

The device has no moving parts and eliminates all needs for adjustments and secondary operations, and no tools are needed to install or remove a brush or pad. The only item that experiences any wear is the O-ring which is inexpensive and may be easily replaced, and even it has a long life expectancy. Thus the device has long life and long wearing capabilities. It also provides positive centering and the pressure fit about the O-ring eliminates movement off of center which eliminates out of balance conditions. Because of this, it eliminates the need for balancing brushes or pad drivers for speeds up to at least 1600 rpm. It further is cost effective, i.e. low cost, in that it eliminates expensive drive and holding systems used in other devices.

While the lobes have been shown on the hub and the sockets in the ring or backing, it should be understood that under certain circumstances this could be reversed.

In the form of FIGS. 12 and 13, when the interlocks are fully seated the O-ring is spaced a short distance from the ramp and, at the same time, will be under a predetermined compression against the cylindrical surface. The spacing from the ramp has the advantage that when operating on uneven floors the brush or tool may cock slightly without the O-ring popping over the ramp or annulus, which will cause the tool to fall off. At the same time the preload in the O-ring against the cylindrical surface may be increased to more accurately center the tool.

Under certain circumstances in all forms the O-ring might be made an integral part of an overall elastomeric part, rather than a separate part mounted on a metal member, be it a hub as in FIGS. 1–8 and 13 or a tool as in FIGS. 9–12. The latter case would have the advantage that an integral O-ring formation in the tool would not have a tendency to separate from the ring or brush backing.

While the preferred form and several variations of the invention have been shown, described, and suggested, it should be understood that suitable additional modifications, changes, substitutions and alterations may be made without departing from the invention's fundamental theme.

The embodiments of the invention in which an exclusive property or privilege is claimed are defined as follows:

1. In a quick connect/disconnect coupling for use in a surface cleaning machine or the like, a surface working tool with an opening in the center thereof, a generally circular ring connected to the working tool and disposed in its center opening, a drive hub adapted to be fitted down in the ring, an elastic toroid between the ring and hub mounted on one of them and opposing the other; an interference circumference on the other constructed so that when the ring and hub are axially brought together under a certain amount of force, the cirfumference and toroid interferingly bypass each other due to elastic distortion of the toroid, and a plurality of circumferential interlocks between the ring and hub that interfit to transmit rotation from the hub to the ring and working tool.

2. The structure of claim 1 in which the elastic toroid is on the hub.

3. The structure of claim 1 in which the elastic toroid is circumferentially continuous.

4. The structure of claim 1 in which the circumferential interlocks include a plurality of outwardly disposed lobes on the hub and a plurality of matching sockets on the circular ring.

5. The structure of claim 1 further characterized by and including a pilot on the hub that enters the ring ahead of contact between the elastic toroid and the interference circumference.

6. The structure of claim 1 in which the interference circumference is circumferentially continuous.

7. The structure of claim 1 in which the working tool has a disk shape.

8. The structure of claim 1 in which the working tool has a cylindrical shape.

9. The structure of claim 1 further characterized in that the dimensioning is such that when the circumferential interlocks between the ring and hub are fully engaged, the elastic toroid and interference circumference are in engagement with each other.

10. The structure of claim 1 further characterized in that the dimensioning is such that when the circumferential interlocks between the ring and hub are fully engaged, the elastic toroid and interference circumference are in spaced relation to each other.

11. The structure of claim 1 further characterized in that the ring has an upper downwardly and inwardly converging surface and a lower downwardly and outwardly diverging surface defining the interference circumferences between them, the dimensioning being such that when the elastic toroid has been forced through the interference circumference and the hub is fully seated in the ring, the elastic toroid will be in engagement with the lower diverging surface and will be under a certain amount of preload.

12. A surface working element having an opening in the center thereof adapted to receive a driver hub fitted down in the opening of the working element, a circumferential formation in the element's opening adapted to interferingly bypass a complementary circumferential formation on the hub when the two are pressed together under a certain amount of force, one of the circumferential formations being uniformly distortable, and a plurality of circumferential interlocks on the working element constructed and arranged to accept complementary interlocks on the hub so that when the hub is forced into the working element's center opening and the circumferential formations bypass each other, the working element will be mounted on the hub for rotary working operation.

13. The structure of claim 12 further characterized in that the working element has a center ring attached to the center thereof, the circumferential formation and interlocks being formed on the center ring.

14. The structure of claim 12 further characterized in that the opening in the center of the working element opens on both sides thereof.

15. The structure of claim 12 in which the working element has a disk shape.

16. The structure of claim 12 in which the working element has a cylindrical shape.

17. The structure of claim 12 further characterized in that the dimensioning is such that when the circumferential interlocks are fully engaged in the complementary interlocks on the hub, the circumferential formations will be engaged with each other.

18. The structure of claim 12 further characterized in that the dimensioning is such that when the circumferential interlocks are fully engaged in the complementary interlocks on the hub, the circumferential formations will be in spaced relationship to each other.

19. The structure of claim 12 further characterized in that the circumferential annulus formation on the hub is distortable.

20. The structure of claim 12 further characterized in that the circumferential annulus formation on the hub is in the form of an O-ring mounted on the hub.

21. The structure of claim 12 further characterized by and including abutting surfaces on the working element adapted to engage corresponding surfaces on the driver hub when the hub is fully seated in the working element, the uniformly distortable circumferential formation being under a certain amount of preload when the surfaces are engaged.

22. The structure of claim 12 further characterized in that the other circumferential formation is defined by a downwardly and inwardly converging frusto conical surface and a downwardly and outwardly diverging frusto conical surface, the dimensioning being such that when the driver hub is fully seated in the working element, the said one uniformly distortable circumferential formation will be in engagement with one of the frusto conical surfaces and will be under a certain amount of preload.

23. A ring adapted to be mounted in the center opening of a surface working tool and, when fitted therein, being adapted to receive a drive hub connected to a source of power, the ring having a central opening with a circumferential annulus formation defined therein adapted to interferingly and distortably bypass a cooperative annulus formation on the hub when the two are pressed together under a certain amount of force, one of the annulus formations being uniformly distortable, and a plurality of circumferentially arranged open sockets of a certain depth on one of them arranged to accept complementary lobes on the other so that when the hub is forced into and fully seated in the ring's center opening and the circumferential annulus formation on the ring bypasses the cooperative annulus formation on the hub, the distortable annulus formation remains distorted to some degree and the ring and hub are locked together for unitary rotary operation.

24. The structure of claim 23 in which the circumferential annulus formation in the ring is distortable.

25. The structure of claim 23 in which the circumferential annulus formation in the ring is circumferentially continuous.

26. The structure of claim 23 in which the ring formation is separate from and connected to the working tool.

27. The structure of claim 23 further characterized in that the dimensioning is such that when the complementary lobes on the other are fully seated in the open sockets, the annulus formations will be in engagement with each other.

28. The structure of claim 23 further characterized in that the dimensioning is such that when the complementary lobes on the other are fully seated in the open sockets, the annulus formations will be in spaced relationship to each other.

29. In a quick connect/disconnect coupling for use in a surface cleaning machine, a surface working tool with an opening in the center thereof, a generally circular ring formation on the working tool in its center opening, a drive hub adapted to be fitted down in the ring formation, an elastically distortable toroid between the ring formation and hub mounted on one of them and opposing the other, an interference circumference on the other constructed so that when the ring and hub are axially brought together under a certain amount of force, the circumference and toroid interferingly bypass each other due to elastic distortion of the toroid, a plurality of circumferential interlocks between the ring and hub that interfit to transmit rotation from the hub to the ring and working tool, and engaging surfaces between the ring formation and hub that engage when the hub is fully seated in the ring formation and the interlocks are engaged, the elastically distorted toroid being under a certain amount of preload when the surfaces engage.

30. A surface working tool having an opening in the center thereof adapted to receive a driver hub fitted down in the opening of the tool, an inside circumferential annulus in the tool opening adapted to interferingly bypass a cooperative annulus on the hub when the two are pressed together under a certain amount of force, one of the annuli being distortable, a plurality of circumferential interlocks on the working tool constructed and arranged to accept complementary interlocks on the hub so that when the hub is forced into the working tool's opening and the annulus bypass each other the working tool will be mounted on the hub for a rotary working operation, and abutting surfaces on the working tool arranged to engage corresponding abutting surfaces on the hub when the hub is fully seated in the working tool and the interlocks are engaged.

31. The structure of claim 30 further characterized in that the dimensioning is such that when the hub is fully seated in the working tool and the abutting surfaces are engaged, the distortable annulus will be under a certain amount of compression to thereby resist separation of the tool and hub.

* * * * *